US008152325B2

(12) United States Patent
McDermott

(10) Patent No.: US 8,152,325 B2
(45) Date of Patent: Apr. 10, 2012

(54) REFLECTIVE SURFACE ROAD FLARE

(76) Inventor: Kevin F McDermott, Rockledge, FL (US)

( * ) Notice: Subject to any disclaimer, the term of this patent is extended or adjusted under 35 U.S.C. 154(b) by 358 days.

(21) Appl. No.: 12/584,690

(22) Filed: Sep. 10, 2009

(65) Prior Publication Data

US 2011/0058364 A1 Mar. 10, 2011

(51) Int. Cl.
*F21S 8/00* (2006.01)
*E01F 9/00* (2006.01)
*E01F 9/06* (2006.01)

(52) U.S. Cl. ..... 362/153.1; 362/153; 362/190; 362/311.02; 362/335; 404/12; 404/14; 404/16; 404/22

(58) Field of Classification Search ..... 362/153, 362/153.1, 190, 311.02, 335; 404/12, 14, 404/16, 22
See application file for complete search history.

(56) References Cited

U.S. PATENT DOCUMENTS 5,703,719 A * 12/1997 Chen ..... 359/547
5,839,816 A * 11/1998 Varga et al. ..... 362/153.1
6,092,909 A * 7/2000 Sools et al. ..... 362/153.1
7,018,131 B2 * 3/2006 Jordan ..... 404/16
7,273,328 B2 * 9/2007 Hunter et al. ..... 404/12

* cited by examiner

*Primary Examiner* — Stephen F Husar
*Assistant Examiner* — James Cranson, Jr.

(57) ABSTRACT

A reflective surface electric road flare designed to be positioned on a roadway and to emit light to alert oncoming drivers to a hazard on the roadway. The flare comprises a housing supporting a circuit. The circuit comprises an led light source, a power controller and a power supply. The power controller energizes the led light source with the power supply such that the led light source emits light according to its design specification. The emitted light is concentrated about the horizontal by a lens into a horizontal light beam visible throughout the azimuth. Concentrating the emitted light into a horizontal light beam increases its intensity as perceived by oncoming drivers located within the projected horizontal light beam. A portion of the horizontal light beam intersects a top surface of the road flare where it is reflected towards oncoming vehicles. The light reflected from the top surface enhances the visibility of the road flare by increasing the intensity of the light perceived by oncoming drivers and by increasing the perceived size of the illuminating surface of the road flare. The road flare is configured to withstand being run over by vehicles and to resist being moved or shifted to an undesirable location during vehicle run over.

23 Claims, 4 Drawing Sheets

25

REFLECTIVE SURFACE ROAD FLARE

BACKGROUND OF THE INVENTION

1. Field of Invention

This invention relates to a lighting device used primarily as a warning device or road flare. The device is normally stored in the trunk of an emergency vehicle until it is needed to alert oncoming drivers of a hazard in the road. It is commonly used by first responders such as policeman or fireman however it can be used by private citizens as well. In an emergency the user removes the light from his vehicle and places it in the road to signal to approaching vehicles the fact that a hazard exists. It is common practice for several of these devices to be placed in the roadway forming a wedge to guide approaching vehicles around the hazard. Currently both incendiary and electric road flares are in use.

It is important for the road flare to be compact and tough. It must be easy to transport and capable of withstanding vehicle run over. It is also important for a road flare to be highly visible as it is common for a small quantity of road flares to have the task of effectively alerting oncoming drivers of a hazard.

Finally it is important for these road flares to withstand vehicle run over without damage and without shifting from their deployed location. Its ability to both alert and guide drivers depends upon a number of factors including its intensity and the perceived size of its illuminating surface.

2. Prior Art

Prior art identification of short term road hazards includes small electric lights, electric road flares or incendiary road flares that are normally placed directly on the road. Prior art electric road flares are also usually designed to be run over by oncoming vehicles without sustaining damage. Road flares are normally placed directly on the roadway as this deployment does not require bulky supporting cones or brackets. However, some suppliers design their road flares to additionally be deployed on brackets or rubber cones as this lifts the road flare closer to eye level so that it can be more easily seen by oncoming drivers.

Led light sources which are the light sources employed in most of the electric road flares typically emit their light into a hemisphere. If the road flare is to be deployed primarily directly on the road with its base horizontally disposed the design objective would normally require a more intense light along the horizontal direction. This would be accomplished with a light concentrating lens. Some led lamps are available with integral light concentrating lenses which concentrate the light about the center of the hemispherical emission pattern of the led emitter. These led lamps are in use in prior art designs as shown in FIG. 13 to be later described. These prior art designs comprise a circle of led lamps (typified by a commercial T 1¾ led lamp) disposed in a horizontal plane and directed radially outward with each led lamp having its own lens for concentrating its individual emitted light into a horizontal beam. The light from the circle of led lamps combines to form a horizontal light beam. These designs create a road flare having a concentrated horizontal light beam and a compact pancake contour without projections.

Other prior art suppliers which deploy their road flares on the roadway and in a plurality of other orientations relative to the observer simply place the led light source directed vertically upward in a housing without a horizontally concentrating lens. In these designs the emitted light substantially fills the hemisphere above the road flare. In these designs only a small fraction of the light is emitted along the horizontal direction. These prior art road flares when placed directly on a roadway do not concentrate a large percentage of their emitted light along the horizontal however they do provide a road flare which is visible from most angles of approach within the upper hemisphere. This design is visible as a device placed on the roadway, attached to a bracket and rotated or when viewed from helicopters. However, since its emitted light is not concentrated about the horizontal during roadway deployment it is substantially less intense when on the roadway and viewed by oncoming drivers. FIGS. 10 through 12 to be later described represent these prior art designs.

Prior art does not include the following features:

- Prior art does not provide an electric road flare for disposition on a roadway with a a single led light source emitting light that is collected by a lens into a substantially horizontal light beam.
- Prior art does not provide an electric road flare for disposition on a roadway having an led emitter emitting light that is collected by a lens into a substantially horizontal beam and further comprising a reflective surface exterior to the lens redirecting a portion of the horizontal beam emerging from the lens diverging from the horizontal towards the horizontal.
- Prior art does not provide an electric road flare for disposition on a roadway with a single led light source emitting light that is concentrated into a horizontal light beam visible throughout the azimuth.
- Prior art does not provide a compact electric road flare for disposition on a roadway and emitting a horizontal light beam from a location above its housing and at a maximum height above the roadway
- Prior are does not provide an electric road flare which collects the heat created by its light creating element into a small exterior light transmitting surface to encourage melting of snow on the surface.
- Prior art does not provide an electric road flare that is low in profile having a contour that is structurally strong enough to withstand vehicle run over and that resists flipping over or location shifting during vehicle run over.

OBJECTS AND ADVANTAGES

The objects and advantages of the present invention are to improve upon the safety of the prior art electric road flares by improving their visibility, making them more deployable, more compact, more stable and more reliable. The present invention is often used in groups of three to eight placed on the roadway to define short term hazards. The individual road flares are small and compact so they can be easily carried to the required location, placed on the roadway and run over without damage. In spite of its small size, ground level placement and small deployment quantities the present invention provides an emitted light which is effective in alerting drivers to the existence of a hazard and effective in guiding drivers past the hazard. A hazard warning system for long term hazard zones usually employs a large number of flashing and steady electric lights mounted well above ground level on barricades. Therefore, due to the added operational requirements and limited number deployed, road flares of the present invention which are used for short term hazards must incorporate innovative design features in order to make them an effective warning system.

The present invention requires only a single led emitter and an optic to concentrate its emitted light into a horizontal light beam. Concentrating the light about the horizontal makes it substantially brighter when observed by drivers of oncoming vehicles which are approaching along a horizontal. Since it is critical for the road flare to be highly visible and to have a long battery life increasing the intensity as viewed by oncoming drivers without increasing the power consumption will have a beneficial effect.

In addition to its intensity the visibility of a road flare is related to the size of its light emitting surface. An enlarged light emitting surface can improve the visibility of the road flare and one means of increasing the size of the light emitting surface would be to increase the size of the road flare such that its illuminating surface would approximate the large size required by the National Highway Traffic Safety Administration. Increasing the size of the road flare would enlarge its emitting surface and improve its visibility. In addition increasing the size of the road flare could beneficially improve the ability of the optic to reduce variations in the width and direction of the emitted light beam. Therefore for some lighting devices an increase in size would be desirable. Unfortunately increasing the size of the road flare is not acceptable. A large road flare would not be as compact as required. It would also create problems for both the road flare and cars as they run over it.

The present invention maintains the compact size and toughness required of a road flare. It also employs an optic to concentrate the light emitted by the led light source into a powerful horizontal light beam. It also addresses production related variations in the beam width and beam direction by employing a reflective surface as part of its housing disposed to reclaim misdirected light. The reflective surface reclaims misdirected light by redirecting it towards oncoming drivers thereby increasing the light energy directed above the horizontal where drivers can see it while simultaneously making the road flare appear as an enlarged illuminating surface. The present invention achieves its objectives by configuring its road flare such that its housing has a small dome surrounded by a reflective plateau or surface. The small dome can be a lens or a cover enclosing lens. The light emitted by the led light source is concentrated by the lens so that it emerges from the dome concentrated into a horizontal beam. Due to the small size of the road flare combined with manufacturing variations of the components the emerging light beam can vary in beam width and beam direction. Normally light emerging from the dome and diverging downward towards the roadway would be lost. However in the present invention this misdirected light is intercepted by the reflective surface and redirected upward towards the horizontal. This reflected light will be visible to approaching drivers thereby improving the visibility of the road flare. In addition since the reflected light will appear to approaching drivers as emerging from the reflective surface the road flare will be perceived as having an enlarged emitting surface, hence more visible.

In using a small dome the present invention contradicts some design concepts. As previously indicated road flares are designed to withstand being run over by cars and trucks. Therefore they are configured to support a substantial amount of weight. Basic engineering design recognizes a large dome shape as excellent for such a task. The large dome spreads the weight of the vehicle to the vertical walls on the outer edge of the housing creating a structurally strong device. In the present invention the dome is small so that the reflective surface can intersect and reclaim as much of the misdirected light as possible. The dome is a small projection on top of the road flare which increases the stresses related to supporting a large vehicle as it runs over the road flare. The present invention addresses this added stress by increasing the strength of its housing.

By employing a small dome the present provides several benefits. The emitted light emerges at the maximum height above the roadway for a compact design thereby bypassing dirt, gravel or snow on the roadway. The small dome concentrates the heat generated by the led emitter such that it contributes to melting snow accumulating on the dome. The small rounded dome encourages blowing snow to be blown around it rather than building up against it. It thereby helps in preventing the snow from blocking the emitted light.

The present invention provides a road flare which minimizes its movement as cars drive over it by having a small lens or projection on top of a pancake or disc shaped housing such that the road flare contacts the tire at two locations or points to inhibit the road flare from flipping as the tire passes.

The present invention provides a compact road flare with a powerful horizontal light beam emitted from the top of the housing thereby reducing the possibility of snow or road dirt from blocking the emerging light.

The present invention emits the light through a small projection, dome or lens. The small projection encloses the led light source and traps its generated heat. This trapped heat helps melt snow which may fall on the lens. Melting snow beneficially reduces the possibility of snow obscuring the emitted light.

The present invention emits a light concentrated into a light beam about a horizontal and having a beam width. The design includes a reflecting surface around and below its emitting surface or lens such that a portion of the light beam is intersected by the reflecting surface and reflected towards the horizontal where it increases the percentage of emitted light observable by oncoming drivers. In addition because the reflecting surface is separated from the projection or emitting surface the light is perceived by oncoming drivers as emerging from an enlarged illuminating or emitting surface. This further improves the visibility of the road flare.

Further objects and advantages are realized through combinations of the above distinct advantages.

SUMMARY

In accordance with the present invention an electric road flare for disposition on a horizontal road and comprising a housing having an led emitter energized by a power supply. The led emitter emits light which is concentrated by a lens into a light beam having an angular beam spread about a horizontal. The light beam emerges from a projection at the top of the housing with a portion of the light beam intersecting an exterior surface of the housing. The exterior surface is disposed for reflecting light emerging from the lens diverging downward from the horizontal and redirecting it towards the horizontal to enlarge the perceived illuminating surface of the road flare.

DRAWINGS

Figures

Figure 1:
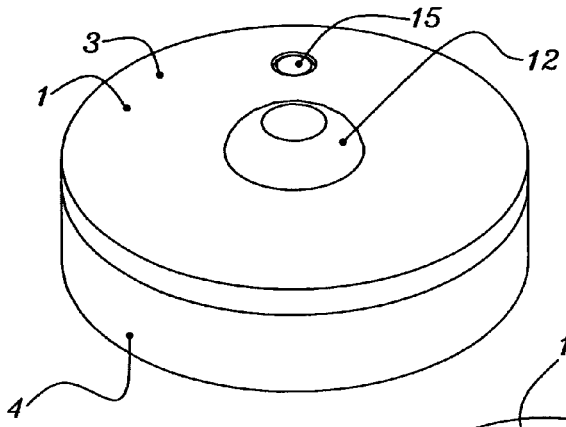
FIG. 1 is a perspective view of road flare 25 according to the present invention
Figure 4:
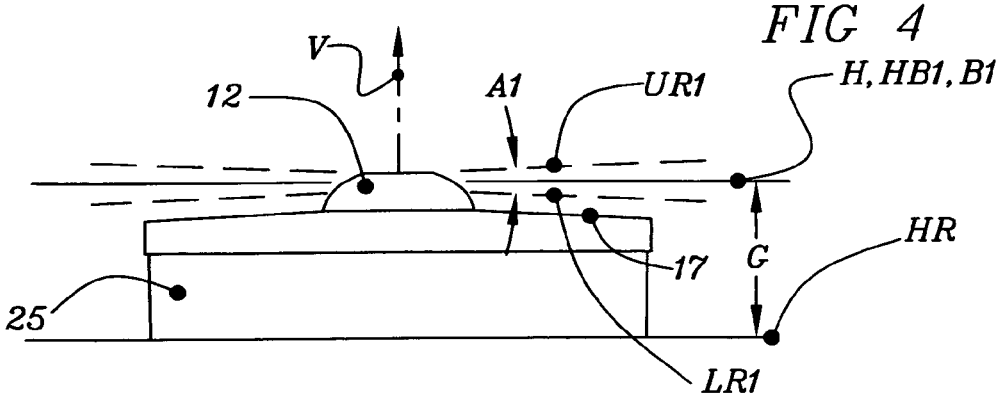
Figure 5:
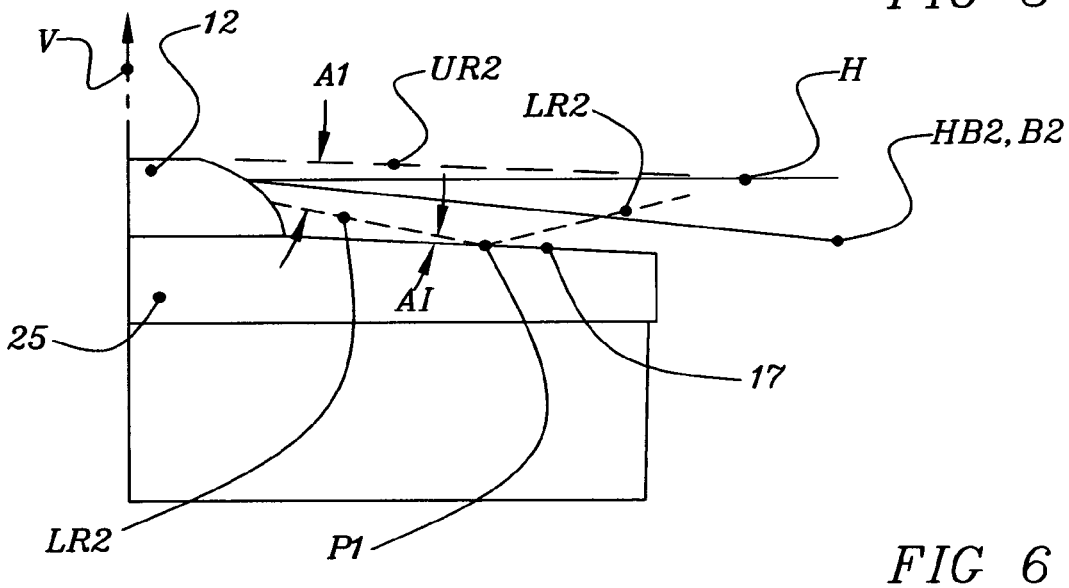
Figure 6:
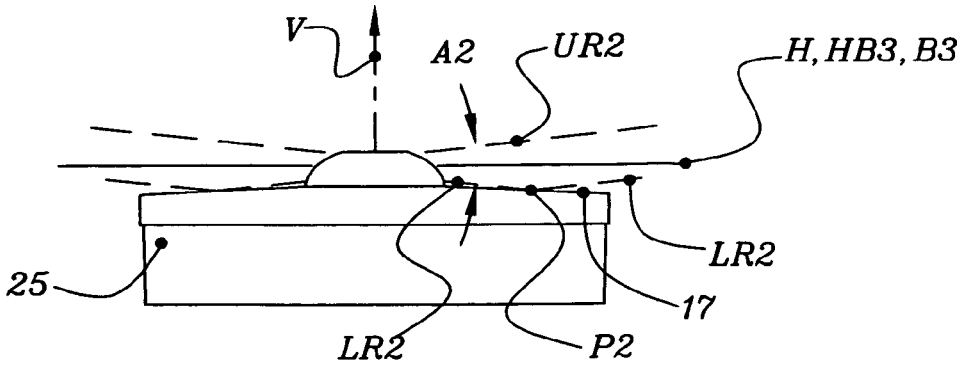
Figure 7:
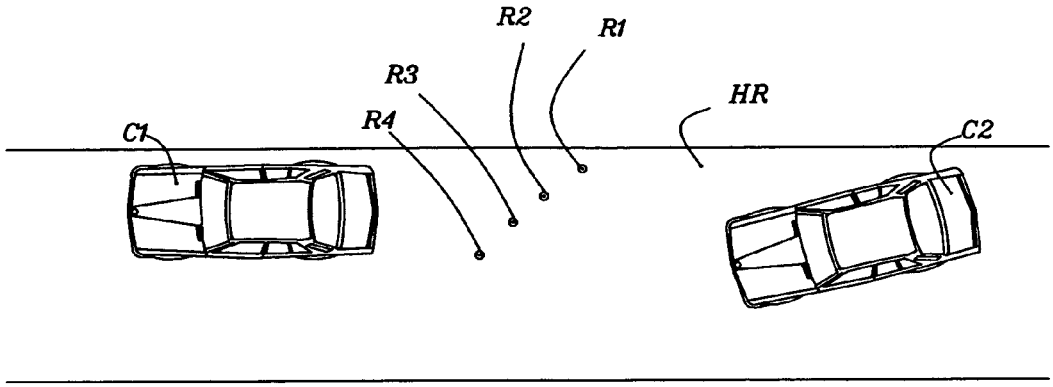
Figure 8:
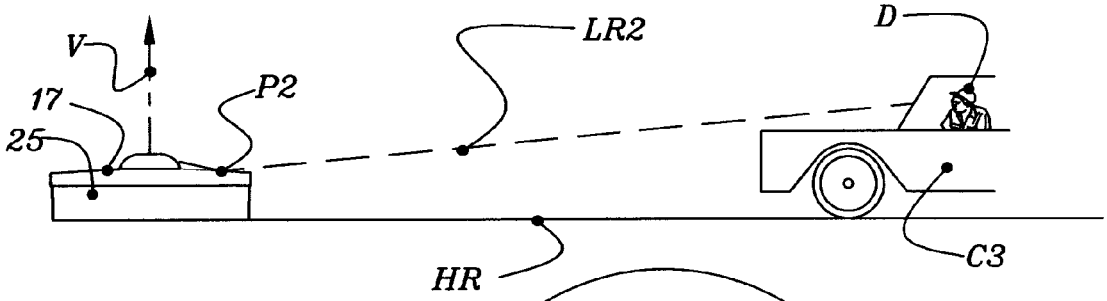

FIG. 4 is a side view of road flare 25 of FIG. 1 showing horizontal light beam HB1 emerging FIG. 5 is an enlarged side view of the right half of road flare 25 of FIG. 1 except it shows horizontal light beam two HB2 emerging FIG. 6 is a side view of road flare 25 of FIG. 1 except it shows horizontal light beam three HB3 emerging FIG. 7 is a top view of a typical roadway hazard scene employing four FIG. 1 road flares deployed to prevent an accident FIG. 8 is a diagrammatic view of an oncoming driver viewing road flare 25 of FIG. 6

Figure 9:
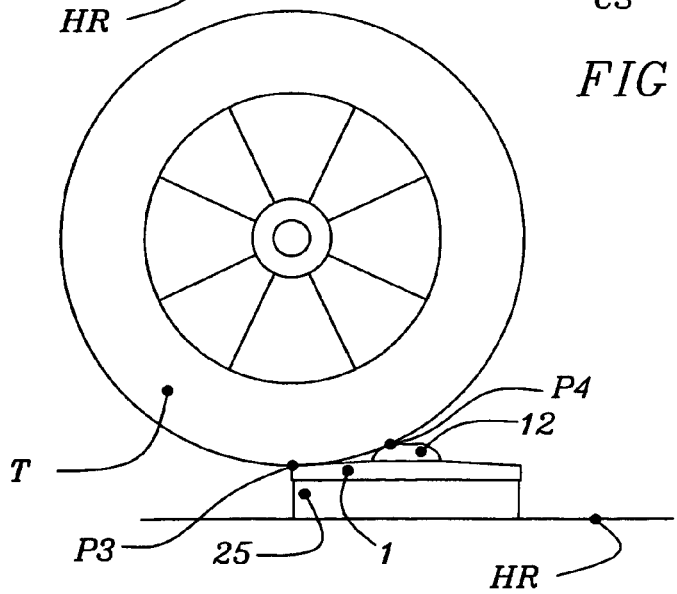
Figure 10:
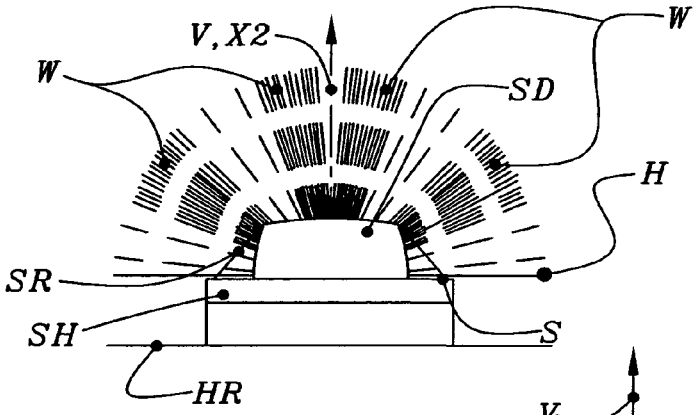
FIG 10 PRIOR ART
Figure 11:
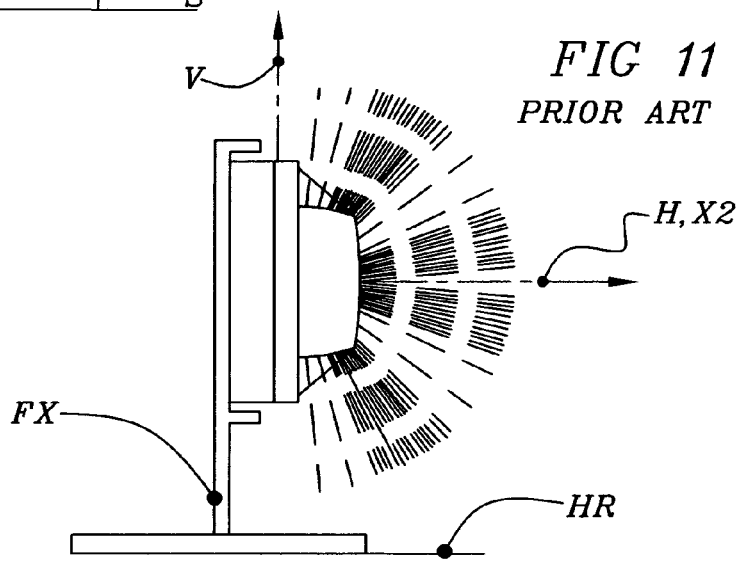
FIG 11 PRIOR ART
Figure 12:
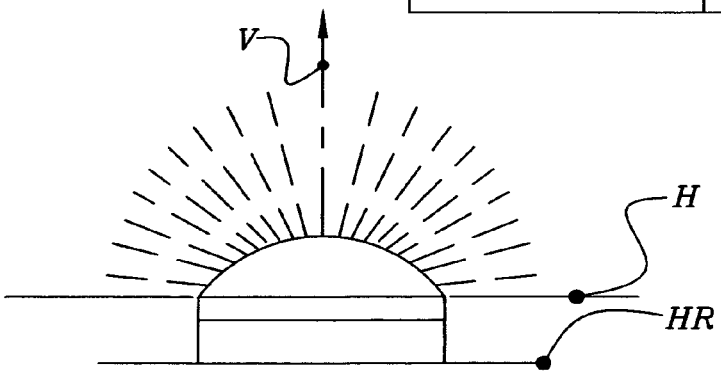
FIG 12 PRIOR ART
Figure 13:
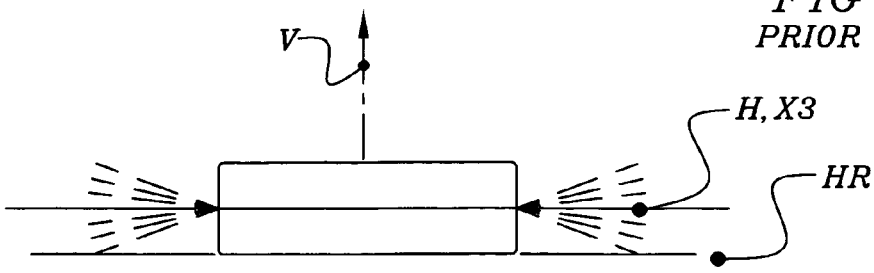
FIG 13 PRIOR ART

FIG. 9 is a diagrammatic view of the road flare of FIG. 8 as car C3 rolls over it FIG. 10 is a side view of a prior art road flare having a large cup shaped top and hemispherically emitted light FIG. 11 is the prior art road flare of FIG. 10 held in a rotated deployment with fixture F FIG. 12 is a side view of a prior art road flare having a fully domed top and hemispherically emitted light FIG. 13 is a side view of a prior art pancake shaped road flare having a circle of led emitters DRAWINGS - Reference Letters

| | |
|---|---|
| A1 | Angular Beam Spread One |
| A2 | Angular Beam Spread Two |
| AI | Angle of Intersection |
| B1 | Beam Center One |
| B2 | Beam Center Two |
| B3 | Beam Center Three |
| C1 | Obstructing Car |
| C2 | Approaching Car |
| C3 | Car |
| D | Driver |
| E | Light Emitting Element |
| F | Focal Point |
| FX | Fixture |
| G | Maximum Distance |
| H | Horizontal Reference |
| HB1 | Horizontal Light Beam One |
| HB2 | Horizontal Light Beam Two |
| HB3 | Horizontal Light Beam Three |
| HD | Housing Base Dimension |
| HH | Overall Height |
| HK | Projection Base Dimension |
| HP | Projection Height |
| HR | Horizontal Road |
| LR1 | Lower Light Ray One |
| LR2 | Lower Light Ray Two |
| P | Intersection Point |
| P1 | Intersection Point One |
| P2 | Intersection Point Two |
| P3 | Point Three |
| P4 | Point Four |
| R1 | Road Flare 1 |
| R2 | Road Flare 2 |
| R3 | Road Flare 3 |
| R4 | Road Flare 4 |
| S | Flat Surface |
| SD | Dome |
| SH | Housing |
| SR | Structural Rib |
| T | Tire |
| UR1 | Upper Light Ray One |
| UR2 | Upper Light Ray Two |
| V | Vertical Reference |
| W | Light Rays |
| X1 | Emitter Pattern Axis |
| X2 | Emitter Pattern Axis of Prior Art FIG. 10 |
| X3 | Emitter Pattern Axis of Prior Art FIG. 13 |

DRAWINGS - Reference Numerals

| | | | |
|---|---|---|---|
| 1 | housing | 2 | circuit assembly |
| 3 | top | 4 | base |
| 5 | external threads | 6 | internal threads |
| 7 | circuit board | 8A | screw |
| 8B | screw | 9 | o-ring |
| 10A | negative battery contact | 10B | positive battery contact |

-continued

| | | | |
|---|---|---|---|
| 11 | spacer circuit board | 12 | plano convex lens |
| 13 | | 14 | battery |
| 15 | switch | 16 | led |
| 17 | reflective surface | 18 | ring shaped rib |
| 19 | | 20 | |
| 21 | | 22 | |
| 23 | | 24 | |
| 25 | road flare | | |

OPERATIONAL DESCRIPTION OF THE PREFERRED EMBODIMENT FIGS. 1-9

Figure 2:
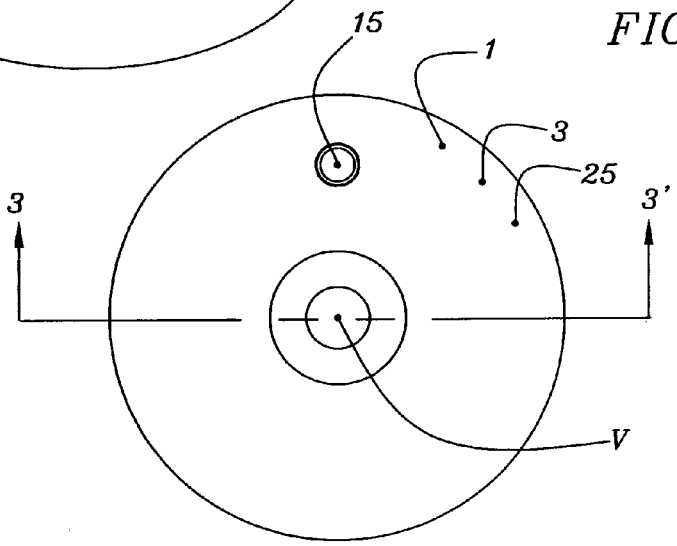
FIG. 2 is a top view of the road flare of FIG. 1
Figure 3:
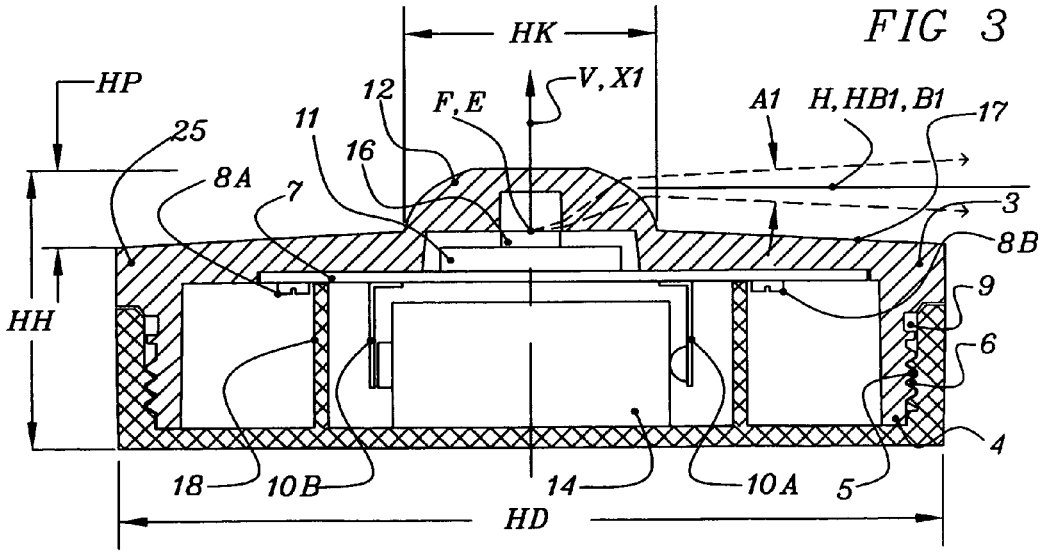
FIG. 3 is an enlarged partial cross section taken across line 3-3' of FIG. 2

Electric road flare 25 of FIGS. 1 through 9 is the preferred embodiment of the present invention. FIG. 1 is a perspective view of road flare 25. FIG. 2 is a top view of FIG. 1 and FIG. 3 is an enlarged partial cross sectional view across line 3-3' of FIG. 2. Looking at FIGS. 1 through 3 road flare 25 comprises housing 1 supporting circuit assembly 2. Housing 1 comprises top 3 molded of a transparent resin and base 4 also molded of a resin. Housing 1 comprises a predetermined compact configuration for a stable disposition on a roadway. The predetermined configuration comprises a low profile and large diameter of housing 1 wherein the ratio of the housing base dimension HD which in this preferred embodiment is the housing base diameter to the overall height HH exceeds two. Finally road flare 25 also comprises a housing base dimension HD which is at least two times a projection base dimension HK which in this preferred embodiment is the projection base diameter. Top 3 has external threads 5 which mate with internal threads 6 on base 4 to permit easy assembly of housing 1. O-Ring 9 seals top 3 to base 4. Housing 1 supports circuit assembly 2 which includes circuit board 7 fastened to top 3 with screw 8A and screw 8B. Circuit board 7 includes negative battery contact 10A and positive battery contact 10B for connecting battery 14 for energizing circuit assembly 2. Led 16 is connected to spacer circuit board 11 constructed of aluminum which in turn is connected to circuit board 7 so that led 16 is positioned with its light emitting element E at focal point F of circular plano convex lens 12 integrally molded on top of top 3. In the present embodiment plano convex lens 12 is considered a projection. In other designs according to the present invention the projection could be a dome or other shape. Circuit assembly 2 functions as a power controller circuit which energizes led 16 with battery 14 when switch 15 is activated. Circuit assembly 2 can have a variety of configurations and components which can easily be designed by one skilled in the art to energize led 16 such that emits light according to its design. Light emitted from led 16 emerges from emitting element E forming an approximately hemispherical pattern having emitter pattern axis X1 coincident with vertical reference V. Light emitted from led 16 intersects plano convex lens 12 where it is refracted and redirected to form horizontal light beam one HB1 disposed throughout a 360 degree azimuth. In this preferred embodiment over fifty percent of the emitted light is redirected by plano convex lens 12 into horizontal beam HB 1. Other configurations of the present invention may redirect twenty five percent or more of the emitted light into the horizontal beam with the remaining light distributed elsewhere. Top 3 has reflective surface 17 which in this preferred embodiment gradually slopes downward and away from plano convex lens 12. It is also exterior to plano convex lens 12 and on the exterior of housing 1. Reflective surface 17 is polished to encourage light intersecting it at small angles to reflect. Ring shaped rib 18 is molded into base 4 to support plano convex lens 12 during vehicle run over to be later described.

Led 16 is a typical led light source or led lamp comprising an led emitter E and typified by red surface mount led manufactured by CREE™ P/N XRE. It is mounted on spacer circuit board 11 which in turn is mounted on circuit board 7 which in turn is fastened to top 3 with the objective that its light emitting element E is positioned exactly at focal point F.

Led 16 is responsible for consuming most of the energy required for road flare 25 to function. Led 16 also generates most of the heat generated by road flare 25. This heat can be useful if road flare 25 is deployed during a snowstorm as it can be used to facilitate melting snow which could cover the light emitting surface of housing 1 which in this preferred embodiment is plano convex lens 12. In the preferred embodiment of the present invention led 16 is disposed within a small compartment at least partially defined by a projection, such as plano convex lens 12, disposed about the top of reflective surface 17 of housing 1 and circuit board 7. Thus the thermal or heat energy created by led 16 is employed to warm plano convex lens 12 thereby facilitating the melting of snow which could accumulate on its surface.

FIG. 4 is a side view of road flare 25 of FIG. 1 showing horizontal light beam one HB1 emerging from plano convex lens 12 which in the present design is the light emitting or illuminating surface of road flare 25. If light emitting element E is positioned exactly as described then horizontal light beam one HB1 will emerge from plano convex lens 12 as shown in FIG. 4. Looking at FIG. 4 horizontal light beam one HB1 emerges from plano convex lens 12 of road flare 25 having angular beam spread one A1 and beam center one B1 which is coincident with horizontal reference H located at maximum distance G from horizontal road HR. Beam center one B1 is the direction within horizontal beam one HB1 which indicates the direction of peak intensity. Upper light ray one UR1 and lower light ray one LR1 define the boundaries of angular beam spread one A1 of horizontal beam one HB1 and generally indicate the directions along which the intensity has dropped to ten percent of its peak value within horizontal beam one HB1. Angular beam spread one A1 is predetermined at a value such that the eyes of drivers of approaching vehicles located at a distance from road flare 25 fall within the angular beam spread but emerge from the angular beam spread when they approach road flare 25. Drivers located at a distance are within horizontal beam one HB1 and they therefore see a bright light. As drivers approach road flare 25 they do not need as bright a light because of their reduced distance from the road flare and the hazard. Therefore the lens directs most of the light towards drivers at a distance where it is most needed increasing the intensity for those drivers and alerting them so they can take timely action to avoid an accident. The present invention in redirecting the hemispherically emitted light towards the horizontal where it is most needed creates a more efficient design. This results because led 16 can be operated at a reduced power level while still effectively alerting distant drivers. Redirecting light emitted about vertical reference V away from vertical reference V towards horizontal reference H does not degrade the performance of road flare 25. This results because once drivers are close to road flare 25 they will see road flare 25 even if they are receiving light at a reduced intensity and even if they are not within the concentrated light of horizontal light beam HB1.

It is noteworthy to realize that horizontal light beam one HB1 emerges from road flare 25 along horizontal reference H and at a substantially maximized distance above horizontal road HR. The distance is limited by the fact that road flare 25 must be compact and of a low profile. Therefore maximizing the distance such that the emerging light emerges unobstructed by road debris is desirable. Horizontal light beam one HB1 emerges from a projection at the top of housing 1. This design minimizes the obstruction of the emitted light beam by debris or snow on the road.

Unfortunately horizontal beam one HB1 as shown in FIG. 4 is an emerging light beam which cannot be consistently repeated in production road flares. Horizontal light beam one HB1 can be consistently repeated on each road flare manufactured only if each light emitting element E used in production is of the exact same size and at the exact same location on its led 16. In addition horizontal light beam one HB1 can only be consistently repeated on production road flares if each light emitting element E is precisely and repeatedly positioned at the exact same location relative to its plano convex lens 12. Finally for horizontal light beam one HB1 to be repeated each plano convex lens 12 must be an exact duplicate of the lenses used on other production road flares. Variations during the manufacture of each component combined with assembly tolerances assure that the horizontal light beam emitted from a variety of road flares will vary in angular beam width and beam center direction.

Looking now at FIG. 5 which is an enlarged side view of the right half of road flare 25 of FIG. 1 except FIG. 5 shows horizontal light beam two HB2 emerging from road flare 25. Horizontal light beam two HB2 represents a typical variation in the light emerging from road flare 25 which could result from a variation in production. Horizontal light beam two HB2 comprises the same angular beam spread one A1 of horizontal light beam one. However, beam center two B2 is now tilted down and away from horizontal reference H. Upper light ray UR2 is also tilted down but still remains productive as it can be seen by oncoming drivers. Lower light ray LR2 is tilted down and intersects reflective surface 17 at intersection point P1 where it is reflected upward towards horizontal reference H and towards beam center two B2 where it becomes productive in that it can now be seen by oncoming drivers. Reflective surface 17 is perceived by oncoming drivers as a light emitting or illuminating surface and adds to the illuminating surface of plano convex lens 12 thereby enlarging the illuminating surface of road flare 25 as perceived by oncoming drivers. The angle of intersection AI between lower light ray LR2 and reflective surface 17 is very small therefore according to the concepts related to the laws of total internal reflection of basic optics as long as reflective surface 17 is polished or reasonably smooth the light will efficiently reflect. This according to basic optics will occur even if reflective surface 17 is not metalized. If angle of intersection AI is large reflective surface would need to be reflectorized by plating or an equal method.

It is important to realize that reflective surface 17 functions as a reflector even though it is not metalized only when angele of intersection AI is very small. Angle of intersection AI will be small only if road flare 25 is predetermined to have a configuration where lower light ray LR2 emerges from plano convex lens 12 to intersect reflective surface 17 at very small angles. This even occurs only when plano convex lens 12 has a very low profile.

Looking now at FIG. 6 which is a side view of road flare 25 of FIG. 1 except FIG. 6 shows horizontal light beam three HB3 emerging. Horizontal light beam three HB3 like horizontal light beam two HB2 represents a typical variation in the light emerging from road flare 25 which could result from a variation in production. Horizontal light beam three HB3 comprises beam center B3 which is coincident with beam center B1 and horizontal reference H. However angular beam spread two A2 of horizontal light beam HB3 is larger than angular beam spread one A1 of horizontal light beam HB1. Angular beam spread two A2 is bounded by upper light ray two UR2 and lower light ray two LR2. Lower light ray two LR2 heads downward away from horizontal reference H to the extent that it intersects reflective surface 17 at intersection point two P2 where it is reflected and redirected upward towards beam center three B3 and horizontal reference H. It is noteworthy to realize that if lower light ray two LR2 did not intersect reflective surface 17 it would have continued its downward direction intersecting the road where it would serve no purpose.

FIG. 7 is a top view of a typical use for road flare 25 on horizontal road HR where obstructing car C1 is inoperable forming a hazard and road flares R1, R2, R3 and R4 each similar to road flare 25 are placed in a wedge formation to direct approaching car C2 safely around. Road flare 25 is constructed with a wide base, low profile and low center of gravity so that it can be placed on a road and resist displacement by wind or vibration. In addition due to its predetermined configuration it can withstand accidental run over by approaching vehicles and resist being accidentally knocked, flipped or shifted from its position on the road. Road flare 25 is placed directly on a road to indicate hazards such as disabled cars, pot holes, etc. Once placed it has a fixed relationship on the road relative to the hazard. Oncoming drivers can establish the exact location of each of road flares R1 through R4 relative to the hazard and can see a distinct line of lights indicating the exact path to follow relative to the hazard to avoid the hazard. This advantage would be seriously degraded if road flares R1 through R4 were placed on a barricade several feet above ground level as required by the National Highway Traffic Safety Administration (NHTSA) for long term hazards. If the road flares were placed substantially above horizontal road HR the relationship between road flares R1 through R4 and the hazard would change drastically due to their height above the road as the oncoming driver approached the hazard. This would make it difficult for a driver to avoid many types of hazards such as potholes. Thus placing the road flares on the road is of significant value when guiding a driver past a hazard.

FIG. 8 is a diagrammatic view of oncoming driver D at a limited distance viewing road flare 25 as shown in FIG. 6 having horizontal beam three HB3. In FIG. 8 car C3 having driver D is approaching road flare 25 with both car C3 and road flare 25 on horizontal road HR. Looking back at FIG. 6 and especially its emerging light lower light ray two LR2 which is reflected from reflective surface 17 if lower light ray two LR2 were not reflected it would have continued downward into horizontal road HR and be lost. However after reflection at reflective surface 17 it is seen by driver D thereby increasing the visibility of road flare 25. In addition to receiving additional light energy driver D will perceive lower light ray two LR2 as being emitted from intersection point two P2. Intersection point P2 is located at a discernable distance from plano convex lens 12 the perceived illuminating surface of most of the light emitted from road flare 25. Therefore, lower light ray two LR2 not only adds to the quantity of light viewed by driver D it also makes road flare 25 appear as an enlarged illuminating or light emitting surface. Both of the above represent improvements in the visibility of road flare 25.

It is noteworthy to realize that although FIG. 6 shows road flare 25 emitting a light beam having an enlarged angular beam spread due to production variations those same production variations could also have inadvertently reduced the angular beam spread beyond the theoretical or design angular beam spread of angular beam spread one A1 as shown in FIG. 4. An angular beam spread smaller than that shown in FIG. 4 would be unacceptable from a safety perspective. Therefore, in order to assure that the angular beam spread of production road flares remains larger than angular beam spread one A1 regardless of production variations the design angular beam spread must be set to a larger value such as angular beam spread two A2 of FIG. 6. This is done so that production variations which reduce the angular beam spread do not reduce it below the required value of angular beam spread one A1. Because of this FIG. 6 including horizontal light beam three HB3 and angular beam spread two A2 represents the typical emerging light to be expected from production road flares.

FIG. 9 is an enlarged diagrammatic view of road flare 25 of FIG. 8 on horizontal road HR except car C3 has rolled over it and is about to drop back down onto horizontal road HR. In FIG. 9 tire T of car C3 has rolled over road flare 25 and is now contacting housing 1 at point P3 and plano convex lens 12 at point P4. If plano convex lens 12 were not so located tire T would only be pressing down at point P3 of road flare 25 and this—considering that tire T is moving off the edge of road flare 25—would encourage road flare 25 to rotate and flip over. If it did not flip over it would possibly be encouraged to move from its deployed location as tire T dropped off road flare 25 back onto the road. The presence of plano convex lens 12 restricts flip over because road flare 25 contacts tire T at two points pressing road flare 25 to the road and restricting it from flip over. Hence a pancake contour with a projection or dome on its top, like plano convex lens 12 on the preferred embodiment of the present invention, reduces the possibility of the road flare flipping over. If the projection becomes too large in diameter or in height relative to the housing, as to be seen in prior art FIGS. 10 and 12 to be later described, tire T will only contact the road flare at one point and tend to push it parallel to the road as the tire rolls over the device. This pushing effect can cause the road flare to shift or move from its desired location creating a hazard. Thus road flare 25 comprises a predetermined configuration including a projection above reflective surface 17 as a component of a contour which resists flip over or shifting during vehicle run over.

FIG. 10 is a side view of a prior art road flare having a cup shaped dome SD and a single led disposed so that the emitter pattern axis X2 of the hemispherically emitted light from its emitter is coincident with vertical reference V. Dome SD is connected to housing SH with six structural ribs SR substantially equally spaced. The ribs provide support during vehicle run over since they increase the projection base dimension. However they encourage only a single point of tire contact. As previously described a single point of tire contact during a vehicle run over can encourage the road flare to unacceptably shift. The FIG. 10 design includes flat surface S which, although only small in size, could reflect light. However, since there is no optic concentrating the light about the horizontal and therefore no portion of a horizontal light beam for flat surface S to reflect. Hence, this prior art design does not disclose the present invention. Flat surface S supports a switch conveniently located on the top of the road flare. This design is advertised as deployable either as shown in FIG. 10 or rotated ninety degrees and held in a rotated orientation by fixture FX as seen in FIG. 11. This prior art design does not concentrate its light about the horizontal as disclosed in the present invention. There is a lens on dome SD which concentrates some of the emitted light about vertical reference V of FIG. 10 and a second optic on dome SD which concentrates additional light into a light beam which is directed about ten degrees above horizontal reference H. The result, as diagrammatically seen in FIG. 10 as light rays W emerging from dome SD, is that the light emerging from the FIG. 10 prior art is unevenly distributed within the upper hemisphere. Concentrating the light about the horizontal as shown in the present invention is not part of FIG. 10 because it would reduce the vertical intensity necessary for the rotated deployment of this prior art design.

FIG. 12 is a second prior art design similar to that shown in FIG. 10 except that FIG. 12 includes a fully domed top. The fully domed top is excellent for supporting the weight resulting from vehicle run over. There is no reflective surface.

FIG. 13 is a third prior art design in which a circle of led lamps are disposed in a horizontal plane within a partially transparent pancake shaped housing and directed radially outward. Each led lamp—not shown—is disposed with its emitter pattern axis X3 coincident with horizontal reference H and comprises a dedicated lens concentrating its emitted light about the horizontal. FIG. 13 discloses a pancake configuration of prior art which is compact. FIG. 13 is devoid of a small dome or projection on its top. The FIG. 13 design has serious deficiencies. The horizontal light emerging from FIG. 13 emerges midway up the pancake configuration which is close to the roadway. A small amount of dirt or snow on the road can totally block the emerging light. Also, small amounts of snow can be blown up against the side of the pancake and block the light. Finally, the circle of led lamps effectively spreads the heat generated by the group of lamps seriously hindering the heat generated by the led lamps from melting snow which could accumulate and obscure the light. The FIG. 13 prior art design does not include a reflective surface and does not disclose the present invention. Light directed downward intersects the non-reflective road and is lost. The FIG. 13 pancake configuration is also prone to flipping over during a vehicle run over for reasons described in the FIG. 9 analysis of the preferred embodiment of the present invention.

Looking back at FIGS. 1 and 4 the preferred embodiment of the present invention includes plano convex lens 12 which represents a projection above reflective surface 17 at the top of housing 1. This design when considered solely from a structural perspective is not as desirable as the large domed prior art designs of FIGS. 10 and 12. A vehicle running over FIG. 3 will place a large portion of its weight on the small projection represented by plano convex lens 12. This weight must be supported at the small base of the lens and within housing 1 at that location. In order to support the concentrated weight, the present invention requires thick sections and internal supports. The present invention includes the increased structure in return for the increased visibility and safety the design provides.

Looking back at FIG. 3 horizontal light beam one HB1 is projected throughout the azimuth. It is also possible to limit its azimuthal beam spread. This can be done by a change in the shape of plano convex lens 12 or by using a different optic.

Looking back at FIG. 3 of the preferred embodiment of the present invention and prior art FIG. 10 the projection base dimension HK of FIG. 3 is approximately 1.100 inches and the equivalent measurement of FIG. 10 is 2.220 inches excluding structural ribs SR. If structural ribs SR are included the measurement is approximately 5.8 inches. The projection height HP of FIG. 3 is 0.600 inches and the equivalent dimension of FIG. 10 is 0.730 inches. The overall height HH of FIG. 3 is 1.600 inches and the equivalent measurement of FIG. 10 is 1.730 inches. The housing base dimension HK of FIG. 3 is 3.580 inches and the equivalent measurement of FIG. 10 is 3.680 inches.

Looking back at FIG. 8 the increase in visibility of the present invention which results from reflective surface 17 results from the fact that driver D is above road flare 25. In FIG. 8 the reflected light is redirected upward where it improves the visibility of road flare 25. Therefore, the present invention is especially effective when the road flare 25 is on the roadway and the observer is above the road flare where he will see the reflected light rays. This is the deployment relationship under which a driver will perceive road flare 25 as having an enlarged illuminating or emitting surface.

Looking again at FIG. 3 led 16 and plano convex lens 12 are separate components. It is also acceptable within the current invention to employ an led lamp that incorporates a light condensing lens as an integral part of its package. In that configuration of the present invention plano convex lens 12 would be replaced with a dome which would represent a projection and also an illuminating surface above reflective surface 17 on the top of housing 1. Alternatively the integral led lamp lens combination could itself emerge above reflective surface 17 on the top, of housing 1 to form the projection or the illuminating surface.

Finally, looking at FIG. 3 the preferred embodiment of the present invention employed a single led 16 placed on aluminum spacer circuit board 11 with its light emitting element E at focal point F of a low profile plano convex lens 12 at the top of housing 1. An effective road flare has extensive performance requirements including an intense light. At the design stage of the present invention there were a number of serious concerns any one of which could have resulted in an inadequate road flare. For example the heat generated at the single location within a small compartment could damage the led. In addition the low profile plano convex lens 12 was very small thereby creating concerns regarding its ability to efficiently concentrate the light from the light emitting element E.

Under normal design practices, due to the heat transfer requirements of led lamps, led 16 would be placed directly on circuit board 7. However for designs employing a low profile lens like plano convex lens 12 this placement disposes light emitting element E low relative to focal point F encouraging the emerging light beam to head upward. This low disposition of light emitting element E increases the difficulty in efficiently effecting a horizontal light beam emerging from the road flare. Absent spacer circuit board 11 light emitting element E was too low relative to focal point F to efficiently concentrate the light into a horizontal light beam disposed close enough to reflective surface 17 for portions of it to intersect reflective surface 17. The preferred embodiment of the present invention solved this problem by adding an aluminum spacer circuit board 11 to correctly position led 16 and to transfer heat away from light emitting element E. Spacer circuit board 11 is aluminum in the preferred embodiment however for more economical configurations of the present invention it could be of other materials. The FIG. 10 prior art design did not include a spacer circuit board. The FIG. 10 design emitted light directed upward. Hence, prior art designers creating the road flares shown in FIGS. 10 through 13 had design concerns which encouraged their prior art configurations. The present invention overcame the concerns to provide a superior road flare.

Thus the scope of the invention should be determined by the appended claims and their legal equivalents rather than by the examples given.

I claim:

1. A road flare comprising:

a housing for disposition on a horizontal road and containing a power supply energizing an led emitter, said led emitter emitting a light concentrated by an optic into a light beam having an angular beam spread about a horizontal, a portion of said light beam intersecting a surface of said housing and reflected towards said horizontal whereby said road flare is perceived by a driver as having an enlarged illuminating surface.

2. A road flare according to claim 1 which further comprises:

said light having an emitter pattern axis directed substantially along a vertical.

3. A road flare according to claim 1 which further comprises:

said optic concentrating at least twenty five percent of said light.

4. A road flare according to claim 1 which further comprises:

said light beam disposed throughout a 360 degree azimuth.

5. A road flare according to claim 1 which further comprises:

said surface is polished.

6. A road flare according to claim 1 which further comprises:

a spacer board disposed between an led lamp comprising said led emitter and a circuit board, said circuit board within said housing for effecting said power supply energizing said led emitter.

7. A road flare according to claim 1 which further comprises:

an aluminum spacer board disposed between an led lamp comprising said led emitter and a circuit board, said circuit board within said housing for effecting said power supply energizing said led emitter.

8. A road flare according to claim 1 which further comprises:

said road flare having a predetermined low profile configuration encouraging at least two points of contact for withstanding vehicle run over.

9. A lighting device comprising:

a housing supporting a light condensing optic and a circuit, said circuit comprising an led emitter and a power supply, said circuit energizing said led emitter with said power supply, said optic disposed about said led emitter and concentrating a light emitted from said led emitter into a light beam, said light beam having an angular beam spread, a portion of said light beam intersecting an exterior surface of said housing and redirected towards said beam center whereby said lighting device is perceived as having an enlarged illuminating surface.

10. A lighting device according to claim 9 which further comprises:

said light having an emitter pattern axis directed substantially along a vertical.

11. A lighting device according to claim 9 which further comprises:

said optic concentrating at least twenty five percent of said light.

12. A lighting device according to claim 9 which further comprises:

said light beam disposed throughout a 360 degree azimuth.

13. A lighting device according to claim 9 which further comprises:

said exterior surface is polished.

14. A road flare according to claim 9 which further comprises:

a spacer board disposed between an led lamp comprising said led emitter and a circuit board.

15. A road flare comprising:

a housing for disposition on a horizontal road and containing a power supply energizing an led emitter, said led emitter emitting a light having an emitter pattern axis substantially along a vertical, said light concentrated by an optic disposed about a top surface of said housing into a light beam concentrated about a horizontal, said light beam emerging from a projection on said top surface whereby said light beam emerges at a maximum distance from said horizontal road thereby minimizing obstruction of said light beam by road debris.

16. A road flare according to claim 15 which further comprises:

said road flare having a predetermined low profile configuration encouraging at least two points of contact for withstanding vehicle run over.

17. A road flare according to claim 15 which further comprises:

a spacer board disposed between an led lamp comprising said led emitter and a circuit board, said circuit board for effecting said power supply energizing said led emitter.

18. A road flare comprising:

a housing for disposition on a roadway and containing a power supply energizing an led emitter, said led emitter emitting a light, said light emerging from a projection on a top said housing, said road flare having a predetermined low profile configuration encouraging at least two points of contract to resist flip over and shifting of said road flare during vehicle run over.

19. A road flare comprising:

a housing for disposition on a horizontal roadway and containing a power supply energizing an led emitter, said housing supporting a spacer board disposed between said led emitter and a circuit board, said led emitter emitting a light having an emitter pattern axis directed substantially along a vertical, said light concentrated by a lens into a horizontal light beam emerging from a projection above a top surface of said housing, said top surface reflecting and redirecting a portion of said horizontal light beam towards a beam center of said horizontal light beam, said housing comprising a low profile configuration to resist flip over and shifting of said road flare during vehicle run over.

20. A road flare comprising:

a housing having a compact configuration for disposition on a horizontal surface and containing a power supply energizing an led emitter, said led emitter disposed within a compartment at least partially defined by a projection on a top surface of said housing and emitting a light having an emitter pattern axis substantially along a vertical, said light concentrated into a horizontal light beam by a lens, said horizontal light beam emerging from said projection, said housing having a housing base dimension at least two times a projection base dimension whereby the small size of said projection base dimension relative to the limited size of the housing base dimension enhances the ability of the road flare to melt snow and to resist shifting during vehicle run over.

21. A road flare comprising:

a housing for disposition on a horizontal road and containing a power supply energizing an led emitter, said led emitter emitting a light concentrated by an optic into a light beam having an angular beam spread about a horizontal, a spacer board disposed between an led lamp comprising said led emitter and a circuit board, said circuit board within said housing for effecting said power supply energizing said led emitter, a portion of said light beam intersecting a surface of said housing and reflected towards said horizontal whereby said road flare is perceived by a driver as having an enlarged illuminating surface.

22. A road flare comprising:

a housing for disposition on a horizontal road and containing a power supply energizing an led emitter, said led emitter emitting a light concentrated by an optic into a light beam having an angular beam spread about a horizontal, an aluminum spacer board disposed between an led lamp comprising said led emitter and a circuit board, said circuit board within said housing for effecting said power supply energizing said led emitter, a portion of said light beam intersecting a surface of said housing and reflected towards said horizontal whereby said road flare is perceived by a driver as having an enlarged illuminating surface.

23. A road flare comprising:

a housing for disposition on a horizontal road and containing a power supply energizing an led emitter, said road flare having a predetermined low profile configuration encouraging at least two points of contact for withstanding vehicle run over, said led emitter emitting a light concentrated by an optic into a light beam having an angular beam spread about a horizontal, a portion of said light beam intersecting a surface of said housing and reflected towards said horizontal whereby said road flare is perceived by a driver as having an enlarged illuminating surface.

* * * * *